United States Patent [19]

Doyel

[11] 4,195,579

[45] Apr. 1, 1980

[54] PORTABLE SAFE

[76] Inventor: John S. Doyel, New York, N.Y.

[21] Appl. No.: 968,562

[22] Filed: Dec. 11, 1978

[51] Int. Cl.[2] ..... E05G 1/026

[52] U.S. Cl. ..... 109/52; 109/54; 109/59 R; 109/68; 312/204

[58] Field of Search ..... 109/50, 51, 52, 54, 109/57, 59, 64, 68; 70/312; 312/204, 291

[56] References Cited

U.S. PATENT DOCUMENTS

| | | | |
|---|---|---|---|
| 3,166,364 | 1/1965 | Shorin | 109/54 X |
| 3,587,486 | 6/1971 | Heinrichs | 109/51 |
| 4,029,370 | 6/1977 | Ziegel | 109/51 X |
| 4,030,426 | 6/1977 | Lyons | 109/51 |

FOREIGN PATENT DOCUMENTS

| | | | |
|---|---|---|---|
| 392557 | 5/1933 | United Kingdom | 109/51 |

*Primary Examiner*—David H. Corbin

*Attorney, Agent, or Firm*—Cooper, Dunham, Clark, Griffin & Moran

[57] ABSTRACT

Disclosed is a portable safe which when locked wedges itself in a drawer to resist being either opened or removed from the drawer without first being unlocked.

5 Claims, 14 Drawing Figures

PORTABLE SAFE

BACKGROUND AND SUMMARY OF THE INVENTION

The invention is in the field of portable safes or strong boxes. It relates mainly to a portable safe which when locked is secured against removal from a drawer or a similar structure.

Portable safes are a convenience for use at home or when traveling, to protect valuables such as money and jewelry. Since portable safes by their nature are easy to carry off they need to be protected not only against unauthorized opening but also against unauthorized removal of the entire safe. For this reason it has been suggested with respect to some prior art portable safes to use some mechanism to secure the safe to a larger object such as a drawer. Some prior art portable safes of this type have been referred to in British Pat. No. 392,557 and in U.S. Pat. Nos. 4,029,370 and 4,030,426. One disadvantage of the prior art portable safes referred to in these patents is that the particular technique used to secure them to a larger object reduces the amount of interior space available to store valuables and that one must reach inside the safe in order to unlock the mechanism for securing it to a larger object. A similar prior art portable safe is referred to in U.S. Pat. No. 3,166,364. It is also designed to be secured to a larger object, in this case a drawer, but the restraining mechanism is released automatically with the unlocking of the safe. This prior art safe is secured to a larger object by placing it in a drawer of a chest or the like and by pivoting up a part of the safe so as to increase the height of the safe and make it difficult to remove it from the drawer. The part that can be pivoted up for that purpose uses a ratchet and pawl mechanism and other parts which must be manufactured to close tolerances, which makes it expensive to manufacture. In addition, the lid which closes off the interior of this prior art safe is not completely detachable from it, which makes it necessary to include in the safe a removable inner tray so that this tray can be taken completely out from the safe to provide convenient access to the valuables kept in it.

This invention is also directed to a portable safe which can be secured to a larger object, to thus make it more difficult for an unauthorized person to remove the entire safe. Unlike the prior art devices referred to above the invention is directed to a portable safe which is effective but is at the same time simple and inexpensive. More particularly the invention is directed to a portable safe which works by wedging itself in a drawer and resists being either opened or moved from the drawer without first unlocking it. Moreover, the invention is directed to a safe which has a completely detachable lid, so as to provide convenient access to the interior of the safe, and a safe which requires no precision parts and can be made almost entirely of inexpensive molded plastic components which can be easily assembled by hand or with minimal use of tools.

A portable safe embodying this invention includes an open-top container which has a bottom, side walls, a front wall and a back wall which define an interior for storing valuables. An inner lid fits over the container to enclose its interior and bar access to it. This inner lid can be easily removed from the container in its entirety so as to provide convenient access to the valuables stored in the container. There is a substantially rigid outer lid which fits over the container and the inner lid and has a back end pivoted on the container. This outer lid can be pivoted up or down relative to the container to thereby increase or decrease the vertical dimension of the safe. Thus, when the safe is put in a drawer this outer lid can be pivoted up to wedge the safe between the bottom and the top of the drawer.

There is a substantially rigid prop which is pivoted on and extends through the outer lid such that its top end is above the outer lid and its bottom end is below it.

The inner lid has means for engaging the bottom end of the prop during movement of the outer lid and the prop relative to the inner lid, and a locking plate is provided which is coupled to the inner lid and is movable relative to it between a locking position and a released position. In its locking position the locking plate concurrently engages the container to lock the inner lid to it and engages the bottom end of the prop to lock it to the inner lid. In its released position the locking plate does not engage the container and does not lock the prop to the inner lid. Thus, when the locking plate is in its released position the outer lid may be manually moved up to wedge the safe in a drawer or down to unwedge the safe and permit its removal from the drawer. In addition, in the released position of the locking plate the inner lid may be manually lifted completely from the container to permit easy access to its interior. Conversely, when the locking plate is in its locking position the inner lid of the container is kept closed and the outer lid is kept wedged in the drawer, since the prop keeps it from being unwedged. There is a lock, such as a combination lock, coupled with the locking plate. The lock can be locked only when the locking plate is in its locking position. When the lock is so locked the locking plate cannot be moved from its locking position. Conversely, when the lock is not locked the locking plate can move back and forth between its locking and released positions. The locking plate is so moved through a pair of slide pushers which are accessible from outside the safe and can be moved manually.

DETAILED DESCRIPTION

Figure 3:
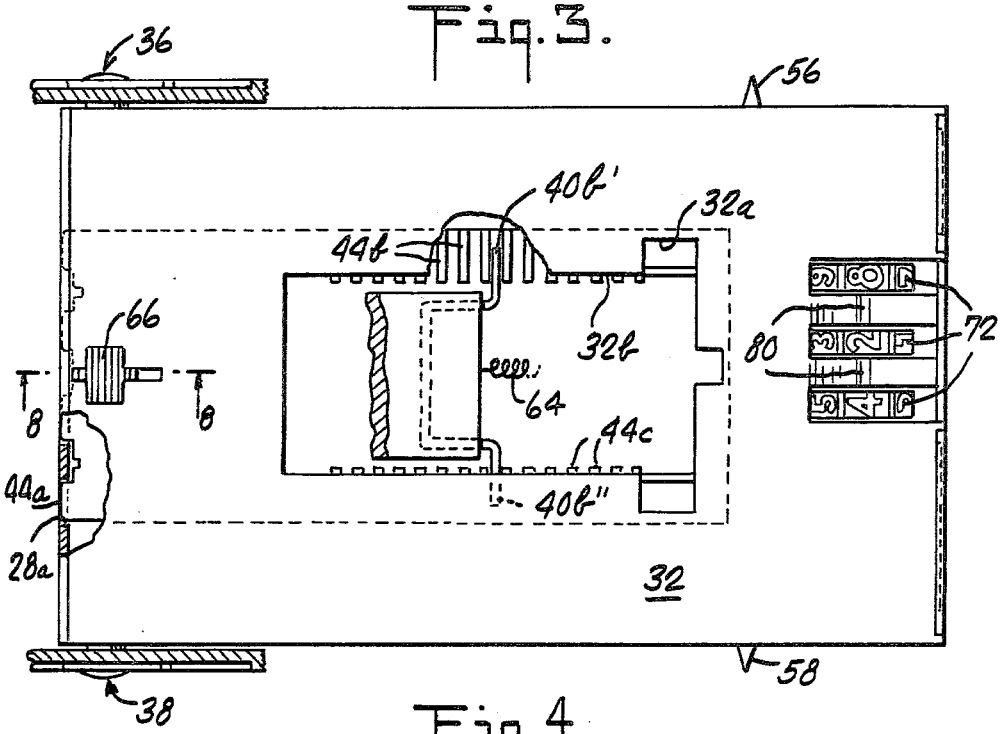
FIG. 3 is a sectional view taken along line 3—3 of FIG. 2.
Figure 4:
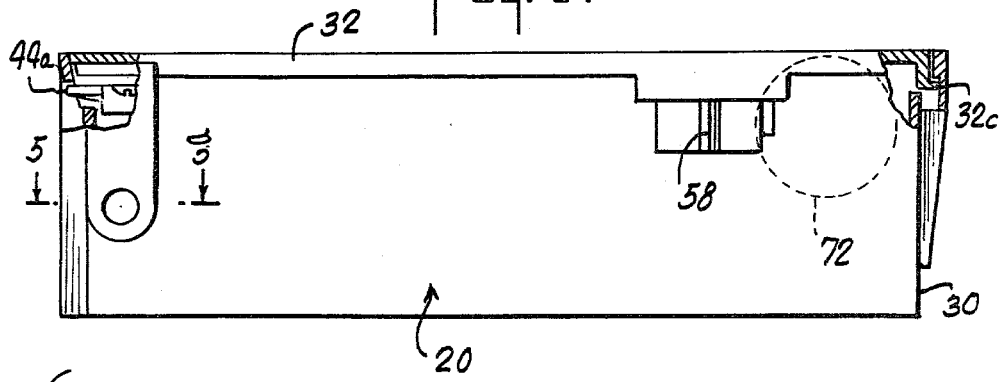
FIG. 4 is a partly sectional and partly side view of the safe without its outer lid.
Figure 5:
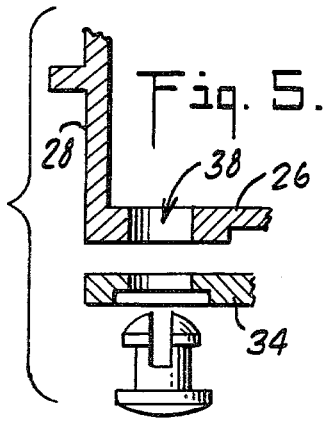
FIG. 5 is a partial sectional view along line 5—5 of FIG. 4.
Figure 6:
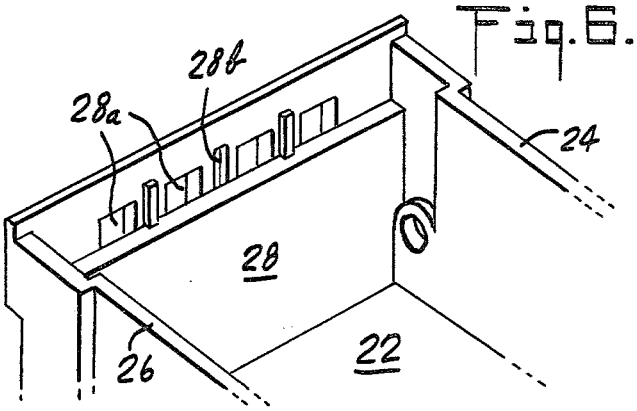
FIG. 6 is a perspective view of a back portion of the safe.

The illustrated embodiment of a portable safe embodying the invention includes an open-top container 20 which has a bottom 22, right side wall 24, left side wall 26, back wall 28 and front wall 30 which define an interior for storing valuables. An inner lid 32 fits over the container 20 to enclose its interior and bar access to it. A substantially rigid outer lid 34 fits over the container 20 and the inner lid 32 and has a back end pivoted on the container 20 at 36 and 38 to pivot up or down relative to the container 20 to thereby increase or decrease the vertical dimension of the safe. A substantially rigid prop 40 passes through a suitable opening 42 in the outer lid 34 and is pivoted on the outer lid 34 at 43. The prop 40 has a top end 40*a* which extends above the outer lid 34 and a bottom end which is below the outer lid 34. The inner lid 32 has means for engaging this bottom end 40*b* of the prop during movement of the prop relative to the inner lid 32. This means includes a slot in the inner lid 32 which has a wider front part 32*a* and a narrower rear part 32*b*. The bottom end 40*b* of the prop has a pair of feet 40*b*' and 40*b*'' which extend toward the respective side walls 24 and 26 of the container. These feet can pass through the wider but not through the narrower part of the slot. When the outer lid 34 is all the way down against the inner lid 32 the feet of the prop are lined up with the wider part 32*a* of the slot in the inner lid 32 and can go through that part of the slot. Thereafter, when the outer lid 34 is manually pivoted up the feet at the bottom end of the prop 40 ride along the underside of the inner lid 32 along the narrower part 32*b* of the slot in the inner lid, as best seen in FIG. 3. The relevant dimensions are such that if the outer lid 34 is pressed down against the inner lid 32 when the feet at the bottom end of the prop 40 are above the inner lid 32 these feet snap in through the wider part 32*a* of the slot in the inner lid 32 and ride along the underside of the inner lid 32 when the outer lid 34 is thereafter manually pivoted up. To release the feet at the bottom of the prop 40 from engagement with the inner lid 32 the outer lid 34 must be pressed down against the inner lid 32 and concurrently the top end 40*a* of the prop 40 must be pressed down against the outer lid 34 to snap the feet of the prop 40 out of the inner lid 32 through the wider part 32*a* of the slot in it.

Figure 1:
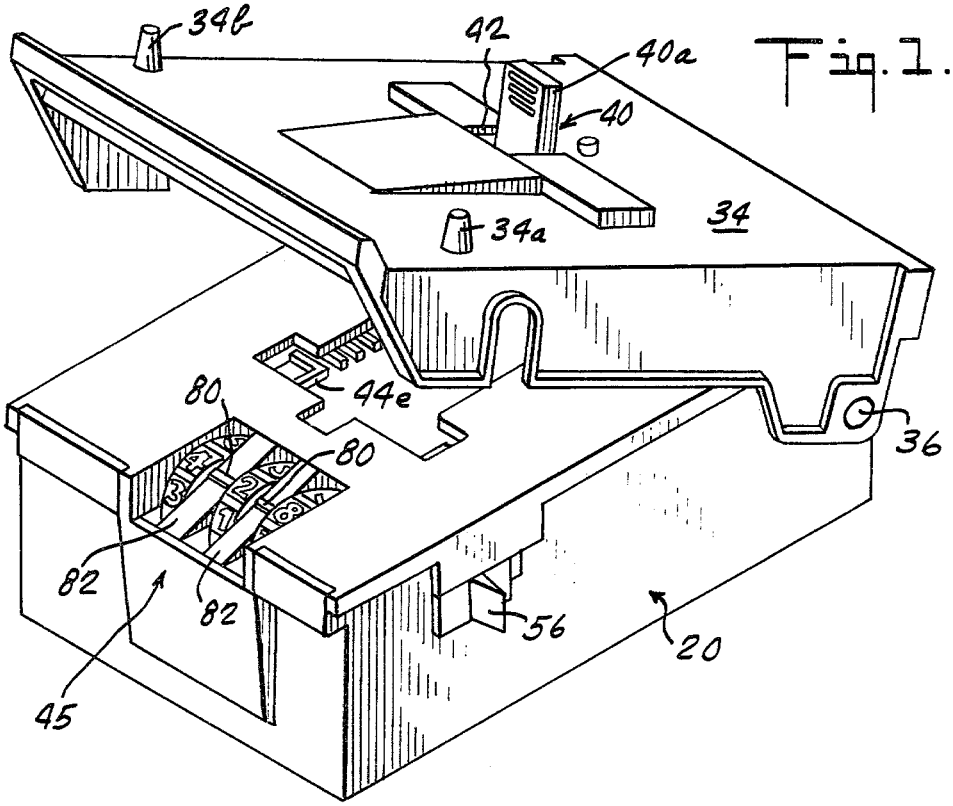
FIG. 1 is a perspective view of a portable safe embodying the invention.
Figure 2:
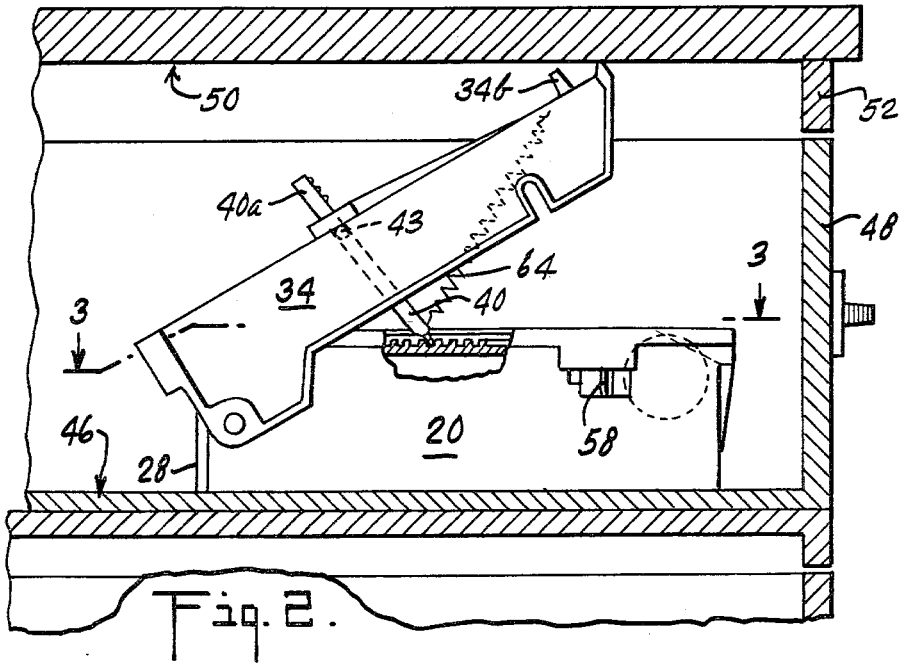
FIG. 2 is a side sectional view through a drawer in which the portable safe has been wedged.
Figure 7:
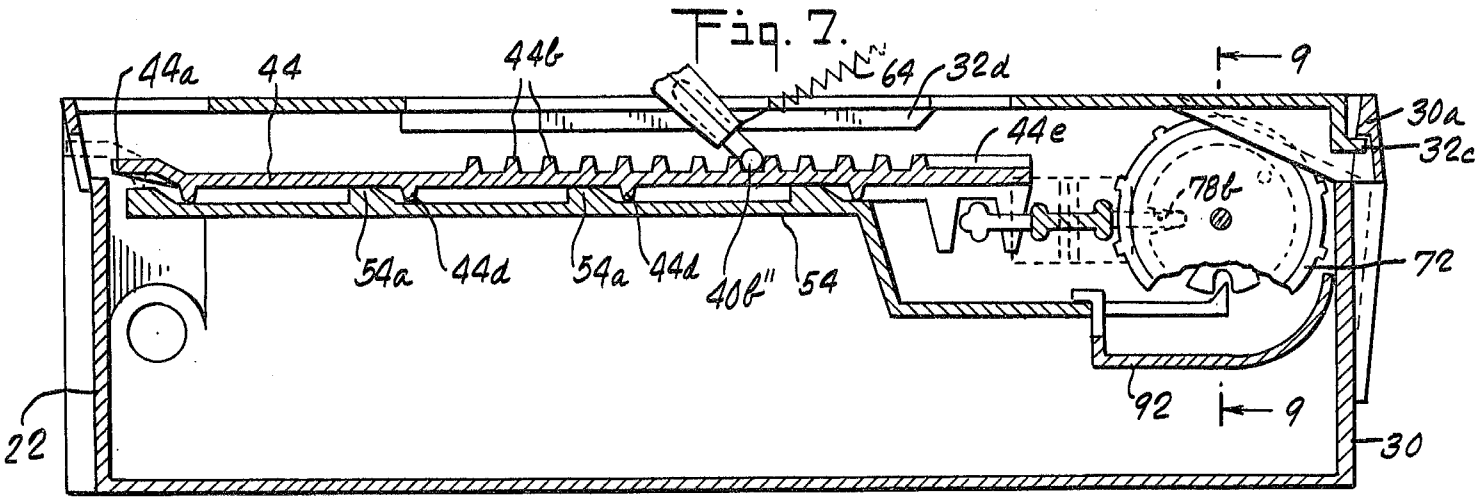
FIG. 7 is a sectional view of a part of the safe showing it in the unlocked position.
Figure 9:
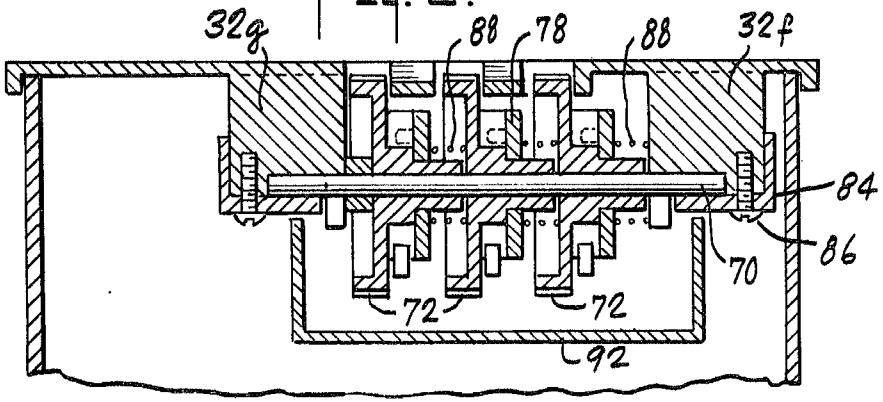
FIG. 9 is a partial sectional view along line 9—9 of FIG. 7
Figure 8:
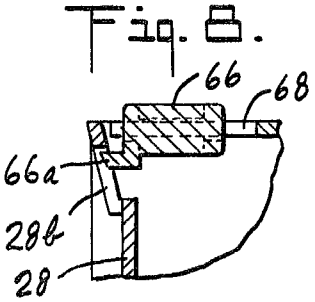
FIG. 8 is a partial sectional view along line 8—8 of FIG. 3.
Figures 10, 11, 12, 13, 14:
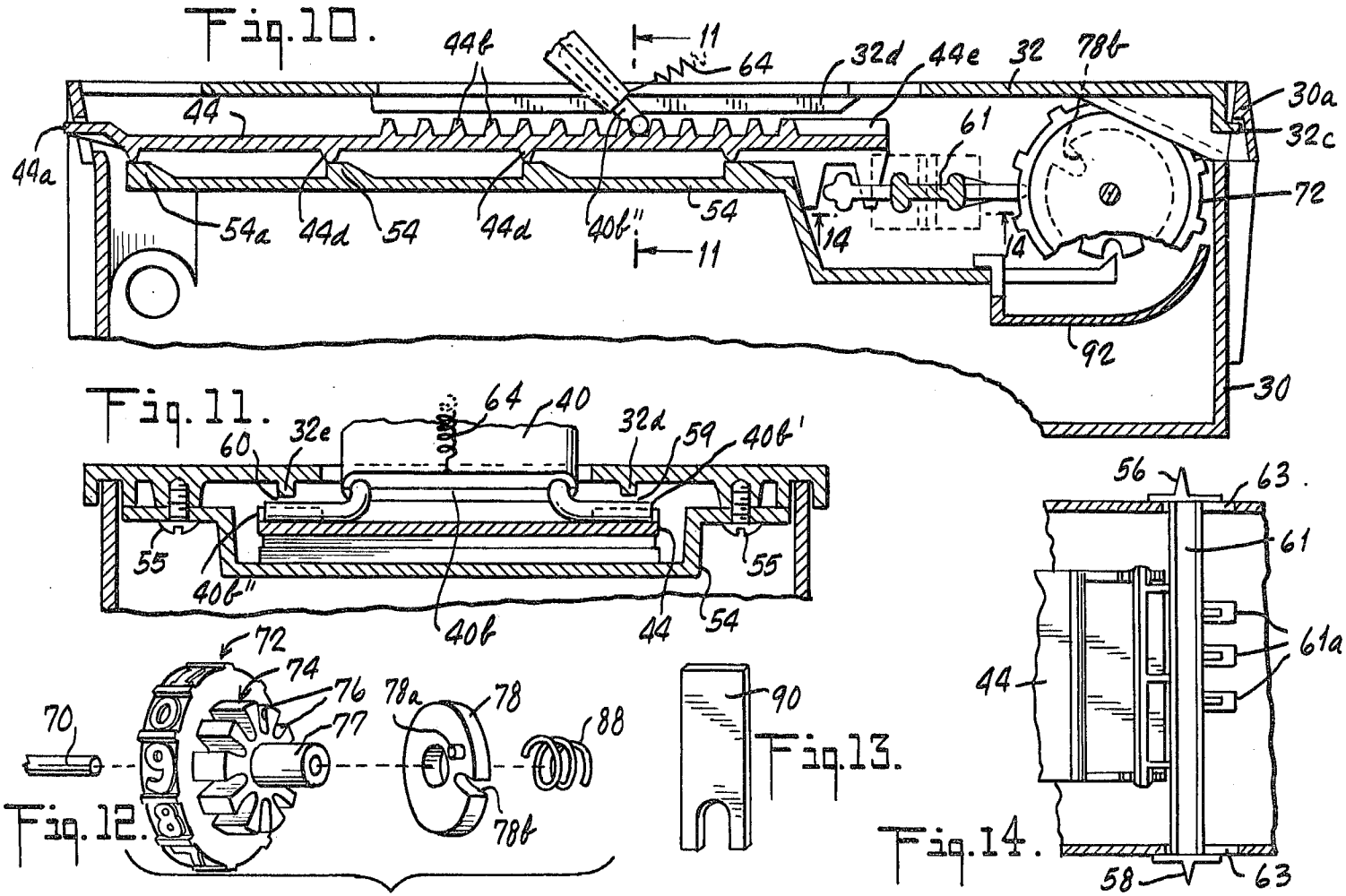
FIG. 10 is a view similar to that of FIG. 7 but showing the safe in its locked position.
FIG. 11 is a sectional view along line 11—11 of FIG. 10.
FIG. 12 is an exploded perspective view of a part of a combination lock of the safe.
FIG. 13 is a perspective view of a tool for resetting the combination lock.
FIG. 14 is a partial sectional view along line 14—14 of FIG. 10.

The inner lid 32 is locked to the container 20 and the outer lid 34 is locked in a position to wedge the safe in a drawer with the help of a locking plate 44 which is coupled to the inner lid 32 and is movable between a locking position and a released position. In its locking position the locking plate 44 concurrently engages the container 20 to lock the inner lid 32 to it and engages the bottom end 40*b* of the prop to lock it to the inner lid 32. This locked position is illustrated in FIGS. 2 and 10. In its released position the locking plate 44 does not engage the container 20 and does not lock the prop 40 to the inner lid 32. This released position is illustrated in FIGS. 7 (in solid lines) and 11. Thus when the locking plate 44 is in its released position the outer lid 34 may be manually pivoted up to wedge the safe in a drawer or down to unwedge the safe, and the inner lid 32 may be manually lifted completely from the container 20 to provide convenient access to the valuables stored in the interior of the container. When the locking plate 44 is in its locking position the inner lid 32 keeps the container closed and, if the outer lid 34 is wedged in a drawer, the prop 40 keeps that outer lid 34 from being unwedged. The safe is illustrated in FIG. 2 as wedged in an exemplary drawer which has a bottom 46 and front 48 and opens to the right by sliding relative to the drawer top 50. In this exemplary drawer there is a bead 52 depending from the top 50 and in line with the drawer front 48 when the drawer is closed. Note that this bead 52 keeps the safe from being taken out of the drawer without first bringing down the outer lid 34.

A combination lock generally indicated at 45 is coupled with the locking plate 44 and has a locked position to which it can be moved only when the locking plate 44 is in its locking position. When the lock 45 is in its locked position it keeps the locking plate 44 from moving out of its locking position. The lock 45 also has an unlocked position in which it does not interfere with movement of the locking plate 44 between its locking and released positions. The locking plate 44 can be manually moved between its locking and released positions (of course only when the lock 46 is in its unlocked position) through slide pushers 56 and 58 which are easily accessible from outside the safe.

The outer lid 34 includes a pair of upwardly extending projections 34*a* and 34*b* which are adjacent to but spaced from the front end of the outer lid, which are designed to make it more difficult to remove the safe from a drawer without first unlocking it and bringing down its outer lid 34. More specifically, these projections make it more difficult to turn the safe, in the case illustrated in FIG. 2, with its back end toward the front of the drawer, partly opening the drawer and then trying to remove the safe from the drawer by lifting up its back end and pivoting it about its front end.

Referring in greater detail to the mechanism for locking the inner lid 32 to the container 20 note, as best seen in FIGS. 7 and 10, that the front wall 30 of the container and the front end of the inner lid 32 have interlocking means engaging each other when the inner lid is fitted in place over the container so as to prevent lifting the front end of the inner lid from the container but to permit lifting the back end of the inner lid. These interlocking means include, in this particular example, a rearwardly facing lip 30*a* along the top end of the front wall 30 and a forward projection 32*c* at the front end of the inner lid 32 which fits under the lip 30*a*. The engagement of the lip 30*a* and projection 32*c* keeps the front end of the inner lid 32 from being picked up from the container 20 even when the locking plate 44 is in its released position shown in solid lines in FIG. 7. However, the inner lid 32 and all elements attached to it can be completely removed from the container 20 by lifting the rear part of the inner lid 32 up from the container and pivoting it about its front end until the projection 32*c* clears the lip 30*a*, at which time the entire inner lid 32 and its attachments can be completely removed from the container 20 to permit easy access to its interior. The back wall 28 of the container and the back end of the locking plate 44 similarly have aligned interlocking means which engage each other when the locking plate 44 is in its locking position, shown in FIG. 10, to keep the back end of the inner lid from being moved away from the container. These interlocking means comprise, in this particular example, several openings 28*a* in the back wall 28 of the container 20 and matching rearwardly extending projections 44*a* at the back end of the locking plate 44 which fit within the openings 28*a* when the locking plate 44 is in its locking position shown in FIG. 10.

The locking plate 44 is coupled with the inner lid 32 by being within the space between the underside of the inner lid 32 and the top side of a tray 54 which is affixed to the inner lid 32 as by screws 55. To assist in locking the prop 40 to the inner lid 32, the locking plate 44 has a row of ridges facing the path of each of the feet of the prop 40 along the underside of the inner lid 32. Thus, there is a row of ridges 44*b* facing the path of the foot 40*b*′ and a row of ridges 44*c* facing the path of the foot 40*b*″. The spaces between the underside of the inner lid 32 and these rows of ridges from respective tracks 59 and 60 for the prop feet. In the released position of the locking plate 44 illustrated in FIGS. 7 and 11 the tracks 59 and 60 have sufficient vertical dimension to permit rearward or forward movement of the prop feet along the tracks. However, when the locking plate 44 is in its locking position, as illustrated in FIG. 10, the vertical dimension of the tracks 59 and 60, i.e. the distance between the tops of the ridges 44*b* and 44*c* and the undersides of depending beads 32*d* and 32*e* of the inner lid 32, is less than the vertical dimension of the feet 40*b*′ and 40*b*″ of the prop 40, and the prop feet must fit in the spaces between adjacent ridges.

In order to help wedge the safe tighter in a drawer when the safe is locked the locking plate 44 not only moves backwardly to lock the inner lid 32 to the container 20 but also moves slightly upwardly to thereby pivot up the outer lid 34 a bit more as the safe is locked. More specifically, the tray 54 includes cam surfaces 54*a* and the locking plate 44 includes cam followers 44*d* which ride up the cam surfaces 54*a* as the locking plate 44 moves rearwardly. The locking plate 44 is moved manually back and forth through slide pushers 56 and 58 which are at the opposite side ends of a bar 61 which extends across the width of the container 20 and interlocks with the front end of the locking plate 44 so as to move forwardly or rearwardly with it. The bar 61 fits in suitable openings 63 and 65 in the side walls 24 and 26 of the container 20.

In order to assist smooth movement of the prop feet within the tracks 59 and 60 the bottom end of the prop may be biased upwardly, as by an extension spring 64 connecting the bottom end of the prop 40 to a point at the forward part of the underside of the outer lid 34. Then, in order to keep the lid 32 fitted in place over the container 20 while the locking plate 44 is in its released position and the prop feet are riding within the tracks 59 and 60, a latch 66 may be provided to slide along a suitable track 68 and the back end of the inner lid 32 and to engage, when in its back position, a suitable opening 28*b* in the back wall 28 of the container with a projection 66*a*.

The combination lock generally indicated at 45 includes a shaft 70 and several number dials 72 (a total of three in the illustrated example) which are mounted next to each other to rotate on the shaft 70. Each number wheel includes an integrally formed lug slot wheel 74 which has a number of radially extending lug slots 76. A lug wheel 78 is mounted coaxially with the number dial 72 to rotate about a tubular shaft 77 which is integrally formed with the number dial 72. The lug wheel 78 has a lug 78*a* and a radial slot 78*b*. Once the combination lock 45 is set the lug 78 is in a particular one of the lug slots 76 and the lug wheel 78 and the number dial 72 rotate as a unit. However, each of the several number dials 72 rotates about the main shaft 70 independently of the other number wheels. When the proper combination of number indicia on the periphery of the several number wheels 72 is aligned with a center mark 80 on respective bars 82 which separate the number wheels from each other the slots 78*b* of all of the slot wheels 78 point rearwardly and are aligned with the fingers 61*a* of the bar 61 which serve as a locking latch and must move into the slots 78*b* for the locking plate 44 to move to its released position. Thus for the lock 45 to be in its locked position all of the number wheels 72 must be in the position which corresponds to the slot 78*b* being as illustrated in FIG. 7. The lock 45 is in a locked position if any of its number wheels 72 has the associated slot 78*b* out of alignment with the respective projection 61*a* of the bar 61, as in the position illustrated in FIG. 10.

The lock 45 is affixed to the inner lid 32 by brackets 84 which, together with studs 32*f* and 32*g* extending downwardly from the inner lid 32, to which they are affixed by screws 86, form a bearing for the main shaft 70 of the lock 45. The lug wheels 78 are kept pressed against the respective slot wheels 74 by respective compression springs 88.

The lock combination can be conveniently changed with the help of a special tool 90 illustrated in FIG. 13. To do this the inner lid and the parts attached to it are removed completely from the container 20 and a snap cover 92 which encloses the underside of the lock 45 is removed to expose the underside of the lock. The forked end of the tool 90 is then inserted between a slot wheel 74 and the associated lug wheel 78, to move the lug wheel to the right as seen in FIG. 12 and disengage the lug 78*a* from its respective slot 76. The associated number wheel 72 may then be manually rotated relative to the lug wheel 78 to a new position, and the tool 90 may then be withdrawn to permit the lug 78 to go into a different slot 76, to thereby reset the lock 45 to a different combination.

In operation, valuables are placed in the safe while the inner lid 32 is away from the container and the outer lid 34 is pivoted up to provide an unobstructed access to the container interior. The front end of the inner lid 32 is then slid into the front portion of the container 20 so as to engage the projection 32*c* under the lip 30*a* of the front wall of the container. At this time the outer lid 34 is pivoted all the way up, the lock 45 is in its unlocked position and the slide pushers 56 and 58 have been moved all the way forward to thereby place the locking plate 44 in its released poisition, and the latch 66 has been slid all the way forward. Once the front end of the inner lid 32 is in place against the front wall 30 of the container the back end of the inner lid 32 is pivoted down to also fit in place over the container 20 so as to align the projections 44*a* with the openings 28, and to align the projection 66*a* of the latch 66 with the opening 28*b* in the back wall of the container. The latch 66 is then slid back to engage the projection 66*a* with the opening 28*b*. The outer lid 34 is then pivoted down and pressed down against the inner lid 32 to snap the feet 40*b*′ and 40*b*″ through the wider part 32*a* of the slot in the inner lid 32, then the outer lid 34 is pivoted up while the feet of the prop 40 enter the tracks 59 and 60. This entry is facilitated by suitably dimensioning the relevant parts of the safe and by providing runways 44*e* aligned with the rows of ridges on the locking plate 44 so as to lead the prop feet into the tracks 59 and 60 at the height of the tops of the ridges and by also bevelling the forward ends of the beads 32*d* which define the upper surface of the tracks 59, 60 for the same purpose. This getting of the prop feet into the tracks may be done while the safe is in a drawer or the safe may be placed in a drawer once the prop feet are in the tracks. With the safe in the drawer the outer lid 34 is pivoted up until it presses against the top of the drawer, and at this time the slide pushers 56 and 58 are pushed back to move the locking plate 44 toward and into its locking position. This makes the locking plate 44 move backwardly and rearwardly while the prop feet are in the spaces between adjacent ridges, and this wedges the safe in the drawer even tighter. Note that the spring 64 helps keep the prop feet against the beads 32*d* and 32*e* while the locking plate is in its released position and thus keeps the prop feet from jamming into the spaces between the ridges of the locking plate. With the locking plate 44 in its locking position the number wheels 72 of the combination lock 45 are turned to new positions. At this time the safe is locked and is wedged in a drawer. To gain access to the interior of the safe the number wheels 72 of the combination lock 45 are rotated to align the proper numerals with the center marks 80 on the bars 82. The slide pushers 56 and 58 are then moved forwardly to thereby move the locking plate 44 to its released position. Once it is in the released position the prop feet can move within the tracks 59 and 60, while being kept riding against the beads 32*d* and 32*e* by the spring 64, and the outer lid 34 may be pivoted down so that the safe can be removed from the drawer. Then the outer lid 34 is brought all the way down against the inner lid 32 and pressed down against it while concurrently pressing down on the top end 40*a* of the prop 40 to snap the prop feet out of the inner lid 32 through the wider part 32*a* of the slot in the inner lid. Note that the latch 66, which at this time is still in the position to which it was slid back, keeps the back end of the inner lid 32 from being lifted up by the action of the spring 64 or by the pressing down of the top end of the prop 40. With the prop feet out of the slot in the inner lid 32 the outer lid 34 is pivoted all the way up, the latch 66 is slid forward and the inner lid 32 may be removed from the container 20 by picking up the rear part of the inner lid 32 and pivoting the inner lid about its front end and then removing it completely from the container to gain unimpeded access to the container interior.

Note that the bar 61 serves both as a means for moving the locking plate 44 rearwardly and forwardly through the slide pushers 56 and 58 and also serves as a locking latch for the lock 45 by virtue of its projections 61*a* which fit in the slots of the lug wheels 78.

The portable safe illustrated above is made almost entirely from inexpensive molded plastic components. The only parts which are not made out of molded plastic material in the particular embodiment described above are the spring 64, the prop feet 40*b*′ and 40*b*″, the screws 55 and 86 and the compression springs 88. The pivots at 36 and 38 are molded plastic slugs which snap into suitable openings through the outer lid 34 and side walls 24 and 26 of the container. The plastic parts may be assembled without the use of tools or with minimal use of tools.

I claim:

1. A portable safe which when locked wedges itself in a drawer to resist being either opened or removed from the drawer without first being unlocked, comprising:

an open-top container which has a bottom, side walls, a front wall and a back wall which define an interior for storing valuables, an inner lid which fits over the container to enclose its interior and bar access to it, a substantially rigid outer lid which fits over the container and the inner lid and has a back end pivoted on the container so that it can be pivoted up or down relative to the container to thereby increase or decrease the vertical dimension of the safe, a substantially rigid prop which is pivoted on and extends through the outer lid such that its top end is above the outer lid and its bottom end is below it, said inner lid having means for engaging the bottom end of the prop during movement thereof relative to the inner lid, a locking plate coupled with the inner lid and movable relative thereto between a locking position in which it concurrently engages the container to lock the inner lid to the container and engages the bottom end of the prop to lock it to the inner lid, and a released position in which it does not engage the container and does not lock the prop to the inner lid, whereby when the locking plate is in its released position the outer lid may be manually pivoted up to wedge the safe in a drawer or down to unwedge the safe and the inner lid may be manually lifted completely away from the container, and when the locking plate is in its locking position the inner lid keeps the container closed and, if the outer lid is wedged in a drawer, the prop keeps it from being unwedged, a lock coupled with the locking plate and having a locked position, to which it can be moved only when the locking plate is in its locking position and in which it keeps the locking plate from moving from its locking to its released position, said lock additionally having an unlocked position in which it does not keep the locking plate from moving between its positions, and slide pushers coupled to the locking plate and accessible from outside the safe to be manually moved, when the lock is in its unlocked position, to thereby move the locking plate between its locking and released position.

2. A portable safe as in claim 1 where the front wall of the container and the front end of the inner lid include interlocking means engaging each other when the inner lid is fitted in place over the container to prevent lifting the ront end of the inner lid from the container but permit lifting the back end of the inner lid from the container, and where the back wall of the container and the back end of the locking plate have aligned interlocking means which engage each other, only when the inner lid is fitted in place over the container and the locking plate is in its locking position, to keep the back end of the inner lid from being lifted from the container, said aligned interlocking means being out of engagement with each other when the locking plate is in its released position.

3. A portable safe as in claim 1 where the bottom end of the prop has a pair of feet extending toward the respective side walls of the container and the means of the inner lid for engaging the prop comprise a slot in the inner lid which has a wider front part and a narrower rear part, the feet of the prop being dimensioned to pass through the wider but not through the narrower part of the slot, whereby the prop feet can be brought to the underside of the inner lid after passing through the wider part of the slot and can thereafter move along the narrower part of the slot while remaining at the underside of the inner lid, said locking plate having a row of ridges facing the path of each of the prop feet along the underside of the inner lid, the spaces between the underside of the inner lid and said rows of ridges forming respective tracks for the prop feet, said tracks being of sufficient vertical dimension when the locking plate is in its released position to permit movement of the prop feet along said tracks but changing to a dimension insufficient to permit such movement when the locking plate is in its locking position to thereby force the feet in the spaces between adjacent ridges, said locking plate having an upward and rearward motion in moving toward its locking position and said motion facilitating wedging the safe in a drawer.

4. A portable safe as in any of claims 1–3 where the lock comprises a combination lock having a plurality of coaxial but independently rotatable slot wheels each having a radial slot facing the locking plate when the slot wheels are in respective positions corresponding to an unlocked position of the lock and including a lock latch coupled to the locking plate for movement therewith relative to the inner lid, said lock latch being located intermediate the locking plate and the slot wheels and clearing said slots only when the locking plate is in its locking position but moving into the slots, to thereby permit the locking plate to move to its released position, only when the slot wheels are in their positions corresponding to the unlocked position of the lock.

5. A portable safe as in claim 4 where the lock includes a radially slotted wheel associated with and coaxial with each of the slot wheels and each slot wheel has an eccentric lug fitting in one of the radial slots of the associated slotted wheel, whereby each slotted wheel and its associated slot wheel rotate as a unit and independently of any other such unit, and where the lock includes means for biasing each slot wheel toward its associated slotted wheel to thereby keep them engaged into a unit, said lock being resettable to a new combination by forcing a slot wheel away from its associated slotted wheel to disengage the lug from its radial slot, rotating the slotted wheel and the slot wheel relative to each other to align the lug with another radial slot of the slotted wheel and thereafter permitting the biasing means to force the associated slotted wheel and slot wheel into a unit having a different angular orientation as between the two wheels.

* * * * *